United States Patent [19]

Miller

[11] Patent Number: 4,488,208

[45] Date of Patent: Dec. 11, 1984

[54] LOW BRIGHTNESS LENS FOR CIRCULAR FLUORESCENT LAMPS

[75] Inventor: Jack V. Miller, Sierra Madre, Calif.

[73] Assignee: Union-Reed Corporation, Chelsea, Mass.

[21] Appl. No.: 409,998

[22] Filed: Aug. 20, 1982

[51] Int. Cl.[3] ..... F21V 5/02; F21V 5/08

[52] U.S. Cl. ..... 362/339; 362/216; 362/223; 362/260; 362/311; 362/337; 362/340

[58] Field of Search ..... 362/215, 216, 222, 223, 362/311, 317, 326, 330, 331, 332, 333, 334, 335, 336, 337, 338, 339, 340, 351, 355, 361, 260, 16, 263; 350/452; 313/116; D26/79, 122, 123

[56] References Cited

U.S. PATENT DOCUMENTS

| | | | |
|---|---|---|---|
| 2,953,675 | 9/1960 | Kluge | 362/216 X |
| 3,009,054 | 11/1961 | Thomas | 362/223 |
| 3,093,324 | 6/1963 | Dobrikin | 362/337 |
| 3,113,728 | 12/1963 | Boyd | D26/122 X |
| 3,320,415 | 5/1967 | Neal et al. | 362/334 |
| 3,731,082 | 5/1973 | Blaylock | 362/216 X |

FOREIGN PATENT DOCUMENTS

| | | | |
|---|---|---|---|
| 952918 | 11/1956 | Fed. Rep. of Germany | 362/16 |

*Primary Examiner*—David H. Brown
*Assistant Examiner*—John E. Griffiths, Jr.
*Attorney, Agent, or Firm*—Wolf, Greenfield & Sacks

[57] ABSTRACT

A transparent lighting diffuser panel is provided for circular gas discharge lamps and having an inner surface, facing the lamp, comprising a generally cylindrical toroidal fresnel lens with the optical centerline of the lens approximately equal to the lamp circle diameter and coaxial with the center of revolution of the lamp tube; and an outer surface, facing away from the lamp, comprising an overall pattern of elongated linear triangular prisms in a radial pattern coaxial with the toroidal lens and the lamp.

12 Claims, 4 Drawing Figures

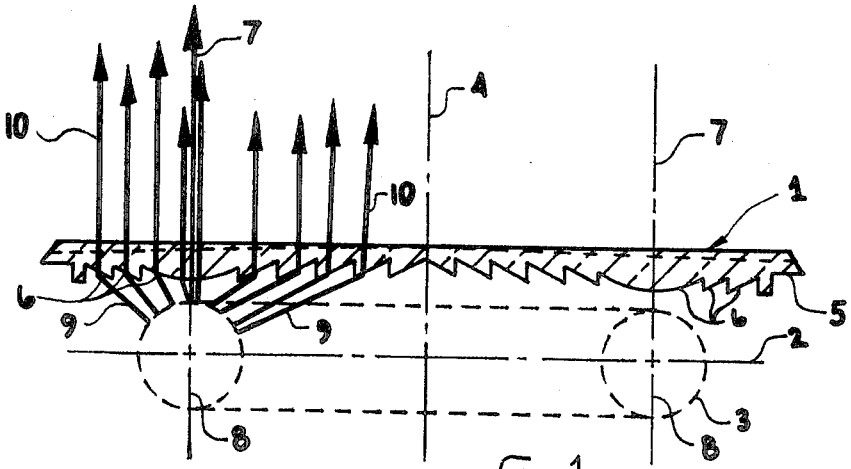
Fig. 1
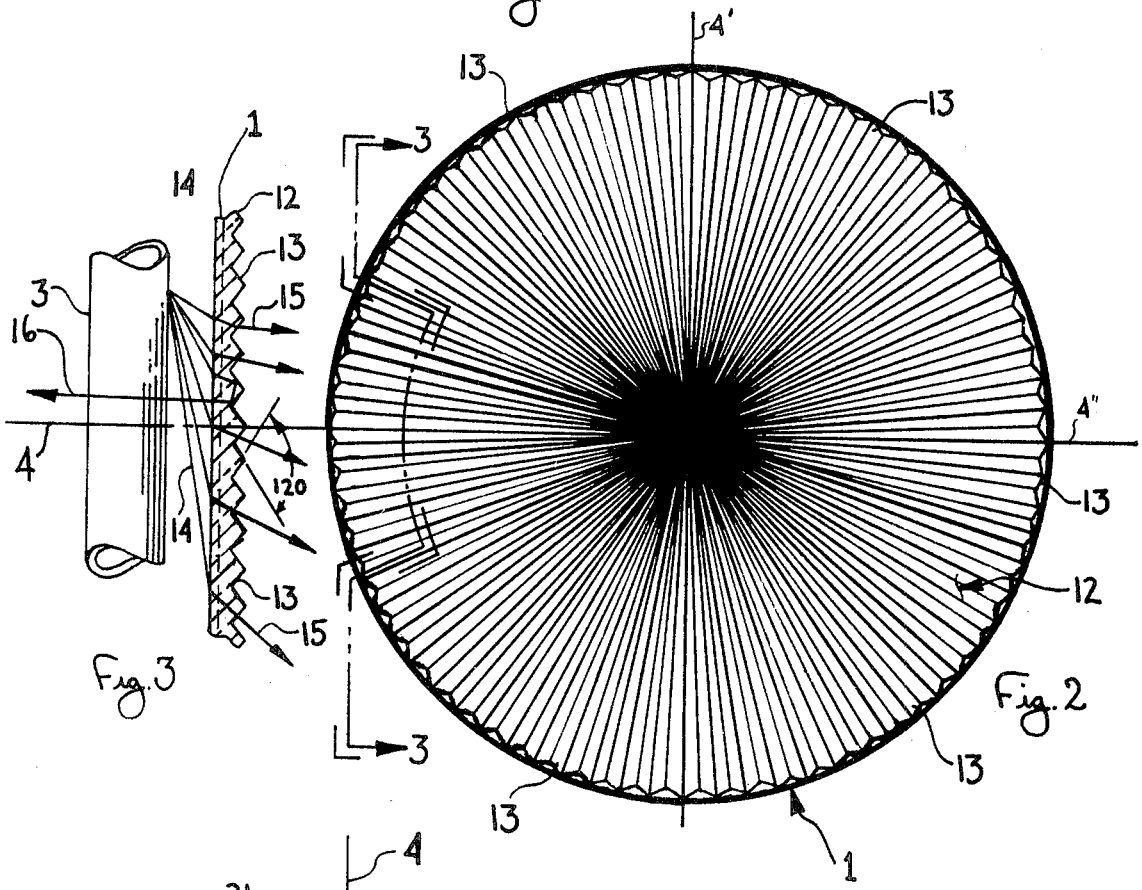
Fig. 3
Fig. 2
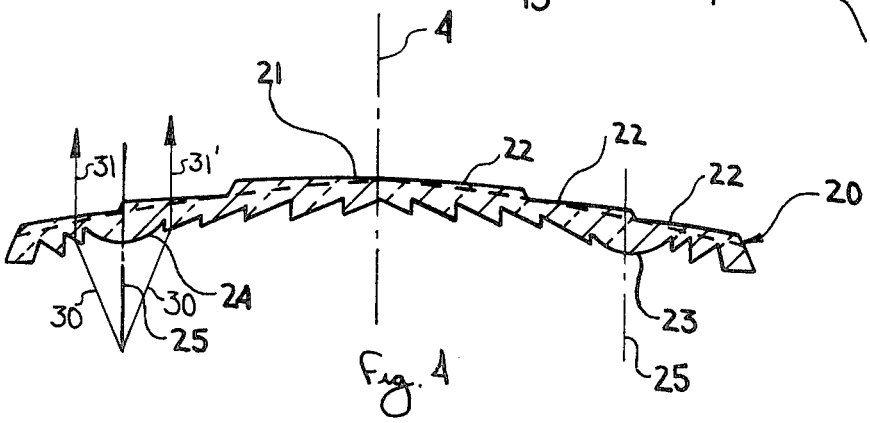
Fig. 4

LOW BRIGHTNESS LENS FOR CIRCULAR FLUORESCENT LAMPS

BACKGROUND OF THE INVENTION

This invention relates to diffusing lens panels for controlling the light output from gas discharge lamps of circular shape, such as the circline type fluorescent lamps in general use, to direct the widely dispersed light from the lamp into a directional beam of useful light, with reduced side glare and efficiency losses.

Circular fluorescent lamps have been widely used in lampholder fittings, such as those described in my inventions of U.S. Pat. Nos. 4,105,276 and 4,178,535, in which bare, exposed lamps are used as screw-in ceiling fixtures and as sources in portable lamps which use shades to direct and control the light. In my co-pending application entitled A CIRCULAR GAS DISCHARGE REFLECTOR LAMP, Ser. No. 409,999, now U.S. Pat. No. 4,420,799, optical control of the lamp is shown by both reflective and refractive means, a refractive means shown therein being the male prism pattern which faces away from the lamp.

The purpose of the present invention is to provide more precise and effective optical control than is possible with the use of a single optical surface, to essentially produce a spotlight or narrow beam floodlight from a fluorescent source of circular shape, and also to produce a lens for the circular fluorescent source that is adapted for use in fixtures and lampholder fittings which also include light control by means of reflectors.

SUMMARY OF THE INVENTION

A transparent lighting panel for circular fluorescent lamps according to the present invention is provided with an inner surface facing towards the lamp, and an outer surface facing away from the lamp, with the panel oriented in a plane parallel to the plane of the circle of a lamp; the inner surface being provided with a fresnel arrangement of a cylindrical toroidal lens with the optical centerline of the torus approximately the same diameter and coaxial with the circular lamp, and the outer surface being provided with an overall pattern of elongated linear and gnerally triangular prisms in a radial pattern coaxial with the toroidal lens of the inner surface. A preferred embodiment provides a lens which is generally convex on the outer surface, and is generally concave on the inner surface.

BRIEF DESCRIPTION OF THE DRAWINGS

FIG. 1 is a cross-sectional view of the lens according to the invention, taken along the central axis of the lens and corcular fluorescent lamp, and showing the inner lens surface structure;

FIG. 2 is a plan view of the outer surface of a circular embodiment of the lens according to the invention;

FIG. 3 is a cross-sectional view of a portion of the lens of FIG. 2, taken along line 3—3; and FIG. 4 is a cross-sectional view of a preferred embodiment of the lens according to the invention, showing a convex/concave configuration.

DETAILED DESCRIPTION OF THE DRAWINGS

In FIG. 1 a lens 1 being a generally transparent panel is shown oriented in a plane generally parallel to plane 2 of a circular gas discharge lamp 3 having a central axis 4. Lens 1 has an inside surface 5 which comprises a fresnel arrangement of a generally cylindrical toroidal lens 6 with a circular optical centerline or an optical center cylindrical ring 7 approximately the same diameter as the lamp diameter 8. Divergent rays 9 from lamp 3 are substantially diected towards a more collimated pattern of rays 10.

In FIG. 2 a plan view of outer surface 12 of lens 1 is shown having an overall pattern of generally triangular male prisms 13 arranged in a radial pattern about the central axis 4 of the lens and lamp.

In FIG. 3 prisms 13 on outer surface 12 of lens 1 are shown having included angles of approximately 120° to direct divergent rays 14 from lamp 3 into more collimated rays 15, and to capture stray rays 16 which might emerge from the lens at excessively high angles with respect to the central axis 4 of the lens and lamp.

In FIG. 4 an embodiment of the invention lens 20 is shown having a generally convex outer surface 21 comprising an overall pattern of tapered triangular prisms 22, arranged in concentric rows about the central axis 4 of the lens. The inner surface 23 is generally concave and is comprised of a fresnel arrangement of a generally cylindrical toroidal lens 24 with a circular optical centerline 25. Due to the cnvex configuration shown, the lens area outside the circular optical centerline is closer to the plane of the lamp, and therefore must have a shorter focal length, ie: greater optical power, than the lens area inside the circular optical centerline. This is evident in the greater angular change of incident rays 30 to become collimated compared to that of incident rays 31.

In operation the fresnel toroidal lens generally collimates divergent rays from the lamp in radial planes about the central axis of the lens and lamp, and the triangular prisms generally collimate the divergent rays from the lamp normal to the radial planes, whereby the lens effectively directs widely divergent rays from the lamp into more collimated rays parallel to the central axis of the lamp and lens.

I claim:

1. A lighting diffuser for a circular gas discharge lamp comprising, a light-transmitting panel, said panel having an overall pattern on one face comprising a Fresnel lens arrangement having an optical center cylindrical ring, said lens focussing light from said lamp into a plurality of parallel rays, which ring intersecting which lamp substantially along its entire length, said panel having a pattern on its other face comprising a radial pattern of elongated, substantially triangular prisms arranged about an axis along the center of said ring.

2. A lighting diffuser for a circular gas discharge lamp according to claim 6 in which the Fresnel lens arrangement is asymmetrical in optical power, with a greater power outside the optical ring and a lesser power inside the optical ring of the lens arrangement.

3. A lighting diffuser for a circular gas discharge lamp according to claim 1 in which the triangular prisms in the radial pattern on the surface of the panel are tapered to a point at the center of the radial pattern.

4. A lighting diffuser for a circular gas discharge lamp according to claim 1 in which the panel is concave on the surface facing the lamp.

5. A lighting diffuser for a circular gas discharge lamp according to claim 1 wherein the pattern of prisms is symmetrical with respect to the centerline of the panel.

6. A lighting diffuser for a circular gas discharge lamp according to claim 1 wherein each of the prisms in said radial pattern are elongated tetrahedrons.

7. A lighting diffuser for a circular gas discharge lamp according to claim 1 wherein the base of each tetrahedral prism faces the lamp.

8. A lighting diffuser for a circular gas discharge lamp according to claim 7 wherein the included angle between two sides of the tetrahedron opposite the base is 120 degrees.

9. A lighting diffuser for a circular gas discharge lamp according to claim 1 wherein the pattern of prisms does not extend to the edge of said panel and the pattern of prisms is bordered on its outer edge by a second pattern of elongated triangular prisms arranged in a radial pattern.

10. A lighting diffuser for a circular gas discharge lamp according to claim 9 wherein the prisms in the second pattern are tapered in a direction toward the center of said panel.

11. A lighting diffuser for a circular gas discharge lamp according to claim 9 wherein the prisms in the second pattern are truncated, elongated tetrahedrons.

12. A lighting diffuser for a circular gas discharge lamp according to claim 9 wherein the prisms in the radial pattern and in the second radial pattern form concentric rows.

* * * * *

UNITED STATES PATENT AND TRADEMARK OFFICE

CERTIFICATE OF CORRECTION

PATENT NO. : 4,488,208

DATED : December 11, 1984

INVENTOR(S) : Jack V. Miller

It is certified that error appears in the above—identified patent and that said Letters Patent is hereby corrected as shown below:

Column 2, line 49, Delete "which" and insert ---said--- in both instances.

Signed and Sealed this

*Twenty-first* Day of *May 1985*

[SEAL]

*Attest:*

DONALD J. QUIGG

*Attesting Officer*

*Acting Commissioner of Patents and Trademarks*